US008201922B2

(12) United States Patent
Sakurai et al.

(10) Patent No.: US 8,201,922 B2
(45) Date of Patent: Jun. 19, 2012

(54) METHOD OF APPLYING INK-REPELLENT FILM AND NOZZLE PLATE PROVIDED WITH INK-REPELLENT FILM

(75) Inventors: Naoaki Sakurai, Yokohama (JP); Masakuni Ikagawa, Ebina (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1190 days.

(21) Appl. No.: 11/856,267

(22) Filed: Sep. 17, 2007

(65) Prior Publication Data

US 2008/0204510 A1 Aug. 28, 2008

(30) Foreign Application Priority Data

Sep. 21, 2006 (JP) ..... P2006-256264

(51) Int. Cl.
*B41J 2/14* (2006.01)

(52) U.S. Cl. ..... 347/45

(58) Field of Classification Search ..... 347/45
See application file for complete search history.

(56) References Cited

U.S. PATENT DOCUMENTS

2003/0097753 A1* 5/2003 Sasaki et al. ..... 29/890.1

FOREIGN PATENT DOCUMENTS

| | | |
|---|---|---|
| JP | 7-314693 | 12/1995 |
| JP | 2004-181883 | 7/2004 |
| JP | 2005-289039 | 10/2005 |
| JP | 2006-51808 | 2/2006 |

OTHER PUBLICATIONS

Japanese Office Action dated Aug. 23, 2011 in Japanese Patent Application No. 2006-256264 filed Sep. 21, 2006.

* cited by examiner

*Primary Examiner* — Jerry Rahll
(74) *Attorney, Agent, or Firm* — Oblon, Spivak, McClelland, Maier & Neustadt, L.L.P.

(57) ABSTRACT

A method of applying an ink-repellent film includes flowing an inert gas to the interior of each of the nozzles in a nozzle plate from the rear surface to the front surface of the nozzle plate; applying a film of an ink-repellent material on the surface of the nozzle plate so as to form a film; and drying the film of the ink-repellent material.

5 Claims, 4 Drawing Sheets

METHOD OF APPLYING INK-REPELLENT FILM AND NOZZLE PLATE PROVIDED WITH INK-REPELLENT FILM

CROSS-REFERENCE TO RELATED APPLICATION AND INCORPORATION BY REFERENCE

This application claims benefit of priority under 35 USC 119 based on Japanese Patent Application P2006-256264, filed Sep. 21, 2006, the entire contents of which are incorporated by reference herein.

BACKGROUND OF THE INVENTION

1. Field of the Invention

The present invention relates to a method of applying an ink-repellent film on the surface of a nozzle plate of an ink jet head and the nozzle plate on the surface of which is provided with the ink-repellent film.

2. Description of the Related Art

There is such a tendency that when an ink wet area appears around a nozzle on the surface of a nozzle plate, direct advance of ink drops becomes impaired, and when wetness becomes more remarkable, ink drops do not fly. As a countermeasure, such a technology that an ink-repellent film made of fluororesin or the like having high water repellency is provided on the surface of a nozzle plate to suppress the appearance of a wet area is proposed (for example, see Japanese Patent Application Laid-Open No. 2005-289039). According to such technology, the ink-repellent film is formed by applying an ink-repellent material onto the surface of the nozzle plate in accordance with a coating method such as screen method and spin coat method, and then, curing the ink-repellent material applied.

However, when the ink-repellent material gets into the interior of the nozzle while the ink-repellent material is applied, it results in a cause for impairing the direct advance of ink drops.

On the other hand, the ink-repellent film once it has got into the interior of the nozzle has high chemical resistance so that it is difficult to remove the ink-repellent film by applying a usual solvent. Thus, the ink-repellent film once it has got into the interior of the nozzle has been removed by the use of laser trimming and the like techniques.

However, when the laser trimming is applied, the surface of the nozzle interior coarsens, and further, there is such a tendency that the direct advance of ink drops is impaired due to remaining dust. As a result, there is a problem of deterioration in printing quality.

Under the circumstances, it is demanded to propose a method of applying an ink-repellent film by which invasion of an ink-repellent material into a nozzle can be prevented as well as a nozzle plate on which the ink-repellent film has been provided in accordance with the above-described applying method.

SUMMARY OF THE INVENTION

According to a first aspect of the present invention, a method of applying an ink-repellent film includes flowing an inert gas to the interior of a nozzle in a nozzle plate from the rear surface to the front surface of the nozzle plate; applying an ink-repellent material on the surface of the nozzle plate so as to form a film; and drying the film of the ink-repellent material.

According to another aspect of the present invention, a nozzle plate has a nozzle plate main body provided with a plurality of nozzles penetrating through the nozzle plate main body; and an ink-repellent film formed on a surface of the nozzle plate main body and provided with a protruding rings surrounding each of nozzle openings defined at the surface of the nozzle plate main body by each of the nozzles.

THE DETAILED DESCRIPTION OF THE INVENTION

Figure 1:
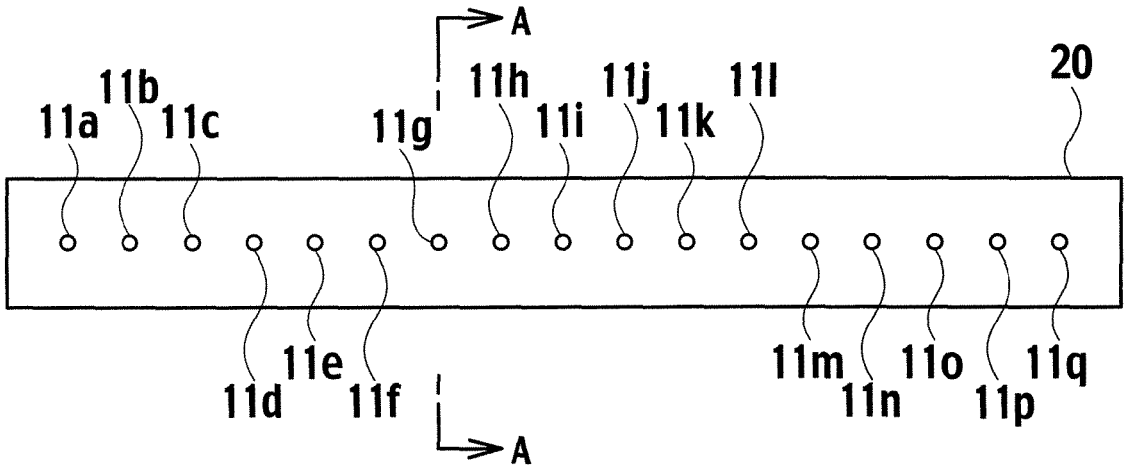
FIG. 1 is a top view showing a nozzle plate.

In the following, the present invention will be described specifically by referring to a embodiments, but it is to be noted that the invention is not limited to the following embodiments. The components in a figure having functions which are the same as or similar to those in the components of the other figures of the accompanying drawings are designated by the reference numerals which are the same as or similar to those in the figures of the accompanying drawings, and the explanations therefor are omitted, respectively.

(Nozzle Plate)

Figure 2:
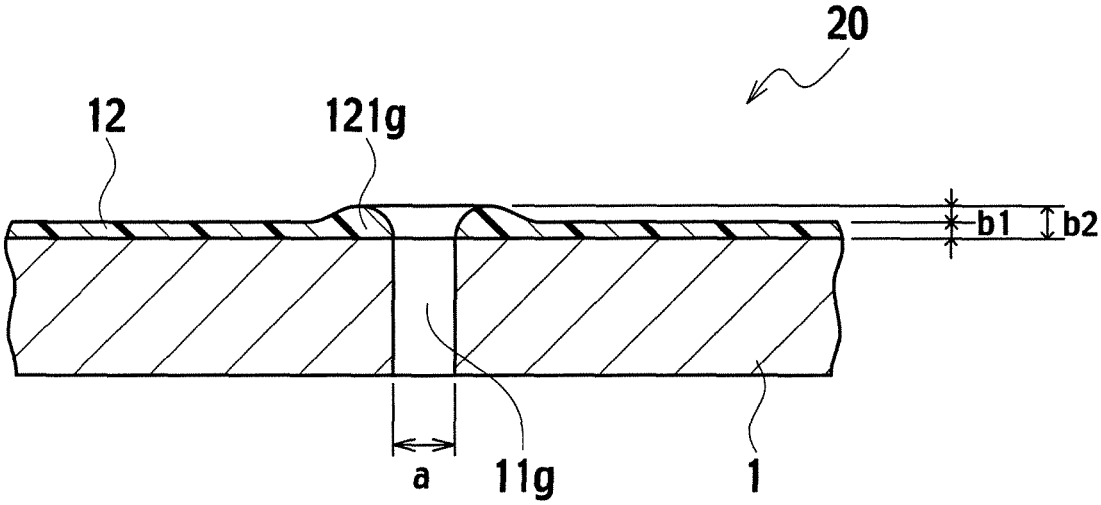
FIG. 2 is an enlarged view, in section, showing the nozzle plate.

FIG. 1 is a top view showing a nozzle plate 20 according to the present embodiment, and FIG. 2 is an enlarged view, in section, showing the nozzle plate 20.

The nozzle plate 20 has a nozzle plate main body 1 and an ink-repellent film 12. The nozzle plate main body 1 is provided with a plurality of nozzles penetrating through the nozzle plate main body. Thus, the nozzle plate 20 is provided with nozzles 11*a*, 11*b*, 11*c*, 11*d*, 11*e*, 11*f*, 11*g*, 11*h*, 11*i*, 11*j*, 11*k*, 11*l*, 11*m*, 11*n*, 11*o*, 11*p*, and 11*q* each having an opening width a by boring apertures in the nozzle plate 20 with a substantially equal distance. The nozzle plate main body 1 is made from stainless steel, Fe-42Ni, resin materials, glass and the like.

As shown in FIG. 2, the ink-repellent film 12 is formed on the surface of the nozzle plate main body 1 and provided with a protruding ring surrounding the nozzle 11*g* opening defined at the surface of the nozzle plate main body 1. The ink-repellent film 12 is provided with a curved contour portion 121*g* in section continuing from the end of a nozzle opening in the peripheral border of the opening in the nozzle 11*g*. Although the illustration is omitted, the nozzles 11*a* to 11*f* as well as 11*h* to 11*q* are provided also with curved contour portions 121*a* to 121*f* as well as 121*h* to 121*q* in their sections continuing from their ends of the nozzle openings in the peripheral borders of the openings in these nozzles, respectively.

For the ink-repellent film 12, fluororesin, for example, a transparent fluororesin (trade name: "CYTOP" manufactured by Asahi Glass Co., Ltd.) may be used. It is preferable that the maximum film thickness b2 of the ink-repellent film 12 formed on the peripheral border of each of the openings in the nozzles 11*a* to 11*q* is 20% thicker or more than a film thickness b1 of the ink-repellent film 12 formed on the surface of the nozzle plate main body 1 except for the openings in the nozzles 11*a* to 11*q*.

Since the contour of the ink-repellent film 12 in the peripheral border of the opening in the nozzle 11*g* is made to be the curved portion in section continuing from the end of the opening of the nozzle 11*g*, such advantageous functions and effects that the ink adhered on the curved contour portion 121*g* in section returns easily to the inside of the nozzle 11*g* because the ink comes down the curved contour portion 121*g* in section are obtained. Thus, a film thickness of the ink-repellent film 12 on the peripheral border of the opening in the nozzle 11*g* is thickened, whereby prevention of an appearance of a wet area of an ink can be effectively achieved. The same advantageous functions and effects of the nozzle 11*g* are obtained also with respect to the nozzles 11*a* to 11*f* as well as 11*h* to 11*q*.

(Method of Applying an Ink-Repellent Film)

In the following, a method of for applying the ink-repellent film 12 will be described.

Figure 3:
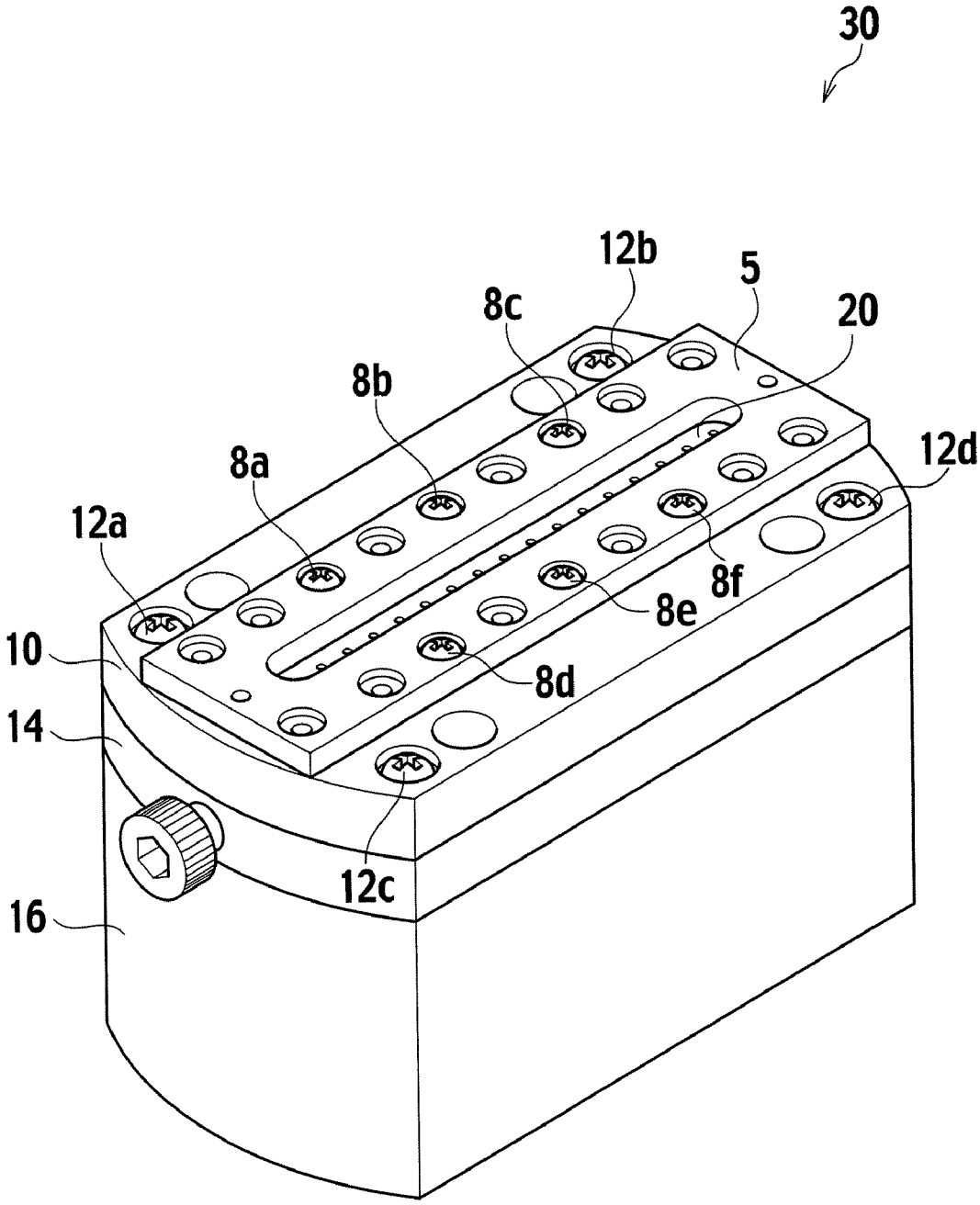
FIG. 3 is a perspective view showing the whole device for applying an ink-repellent film.
Figure 4:
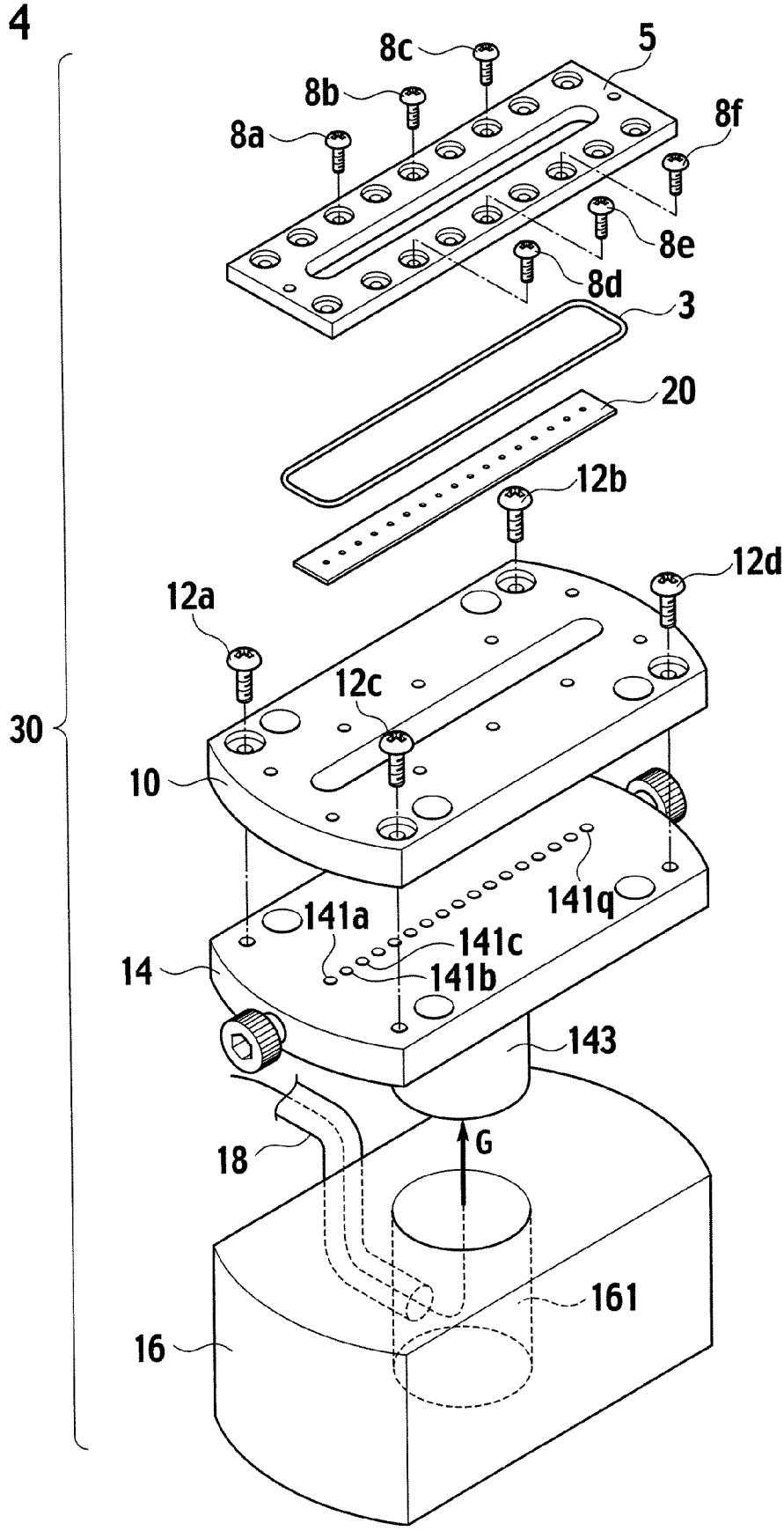
FIG. 4 is an exploded view showing the ink-repellent film applying device.

FIG. 3 is a perspective view showing an ink-repellent film applying device 30 used for the present embodiment wherein the ink-repellent film applying device 30 includes a first block 10 which is arranged by attaching detachably the nozzle plate 20 shown in FIGS. 1 and 2 to a fixing plate 5 through a packing 3 by the use of bolts 8*a*, 8*b*, 8*c*, 8*d*, 8*e*, 8*f* as shown in FIG. 4; a second block 14 provided with inert gas pass-through holes 141*a*, 141*b*, 141*c*, 141*d*, 141*e*, 141*f*, 141*g*, 141*h*, 141*i*, 141*j*, 141*k*, 141*l*, 141*m*, 141*n*, 141*o*, 141*p*, and 141*q* for feeding an inert gas into the nozzle plate 20; and a third block 16 provided with a gas supply pipe 18.

The first block 10 is and the second block 14 are fixed mutually to each other by bolts 12*a*, 12*b*, 12*c*, and 12*d*. On one hand, the second block 14 is joined to the third block 16 by engaging an inert gas pass-through pipe 143 in the second block 14 with an inert gas pass-through pipe 161 in the third block 16. As a result, it becomes possible to remove only the first block 10, or the first and the second blocks 10 and 14 can be removed from the third block 16. The first block 10, the second block 14, and the third block 16 may be made from stainless steel, silicone, ceramics and the like.

An inert gas G fed into the inert gas pass-through pipe 161 in the third block 16 from the gas supply pipe 18 goes outside the ink-repellent film applying device 30 from the nozzles 11*a* to 11*q* of the nozzle plate 20 in the first block 10 through the inert gas pass-through pipe 143 in the second block and through the inert gas pass-through holes 141*a* to 141*q*.

(a) First, an ink-repellant material is prepared. Specifically, a trade name "CYTOP CTL-816A" is blended with a trade name "CYTOP CTSOLV 180" in a volume ratio of 1:10. Thereafter, agitation and defoaming steps are conducted for two minutes each to obtain an ink-repellent material. Although transparent fluororesins of a trade name "CYTOP" manufactured by Asahi Glass Co., Ltd. are used in the present embodiment, other fluorinated resins such as polytetrafluoroethylene resin (PTFE resin), tetrafluoroethylene-perfluoroalkoxyethylene copolymer resin (PFA resin), trifluorochloroethylene resin (PCTFE resin), tetrafluoroethylene-ethylene copolymer resin (ETFE resin), fluorovinylidene resin, and fluorovinyl resin may be used. These fluorinated resins are particularly excellent in water-repellency and solvent resistance with respect to an ink solvent. Furthermore, silicone-based resins and the like may be applied dependent on an ink solvent to be used.

(b) The components shown in FIG. 4 are prepared. The nozzle plate 20 is attached to the first block 10 by means of the fixing plate with the packing 3 sandwiched between the fixing plate and the first block 10. The first block 10 is attached to the second block 14 by means of the bolts 8*a* to 8*f*, respectively. Next, the first block 10 and the second block 14 are attached to the third block 16. An inert gas is fed into the ink-repellent film applying device 30. A flow rate of the inert gas is adjusted to be about 1.0 m/s to about 2.0 m/s.

(c) The nozzle plate main body 1 is coated with a silane coupling agent. Then, the inert gas is sprayed onto the nozzle plate main body 1 in an amount of around 2.0 kg/cm$^2$ from an oblique direction at an angle of 45 degrees before the silane coupling agent is dried. As the inert gas, nitrogen gas, argon gas or the like may be used. From the viewpoint of economical efficiency and operationality, it is preferable to use nitrogen gas.

(d) The first block 10 is removed from the second block 14 with the nozzle plate main body 1 attached. The first block 10 is heated at about 120° C./10 minutes by using a hot plate. Thereafter, it is confirmed that any impurity does not adhere on the interiors of the nozzles 11*a* to 11*q* as well as on the peripheries of the nozzles 11*a* to 11*q*. If any impurity has adhered, the impurity is removed by jetting an inert gas thereon or wiping out. The second block is attached to a spin coater. As the spin coater, any instrument may be used without accompanying any particular limitation so far as it is an instrument which can continue to supply an inert gas to a work area while rotating the work area. It is confirmed whether or not the inert gas does flow by injecting the inert gas into the second block 14. The first block 10 is attached to the second block 14. Then, a flow rate of the inert gas is adjusted to be about 1.0 m/s to about 2.0 m/s.

(e) An ink-repellent material is dropped on the nozzle plate main body 1. Then, the spin coater is actuated to rotate the second block 14 at about 300 rpm/2 s to about 300 rpm/120 s thereby to spin-coating the ink-repellent material. The second block 14 is removed from the spin coater. Then, it is confirmed that any impurity does not adhere on the interior of the nozzles 11*a* to 11*q* as well as on the peripheral borders of the nozzles 11*a* to 11*q*. When there is the adhesion of any impurity, the impurity is removed.

(f) The second block 14 is attached to the third block 16. The inert gas is jetted into the assembled blocks. A flow rate of the inert gas is adjusted to be about 1.0 m/s to about 2.0 m/s. Thereafter, the blocks are heated in a heating furnace at about 185° C./1 hour. Then, the blocks thus heated are cooled naturally. It is confirmed that any impurity does not adhere on the interior of the nozzles 11*a* to 11*q* as well as on the peripheral borders of the nozzles 11*a* to 11*q*. When there is the adhesion of any impurity, the impurity is removed.

Figure 5:
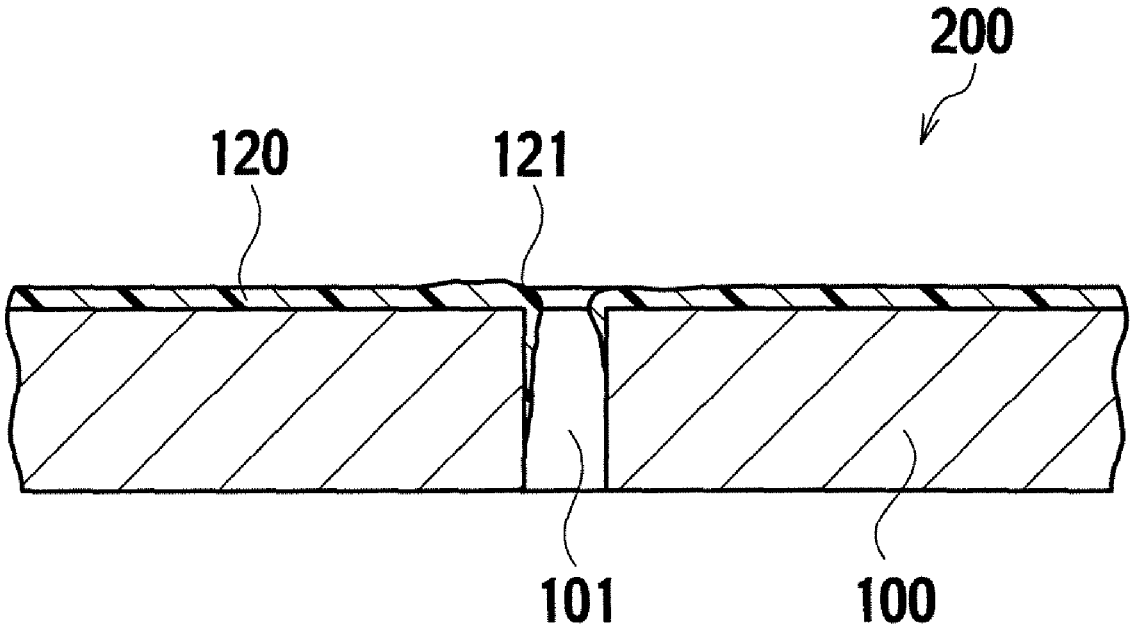
FIG. 5 is an enlarged view, in section, showing a nozzle plate obtained by a conventional manufacturing method.

As a result, the ink-repellent film 12 having a film thickness of b1 to b2 shown in FIGS. 1 and 2 is formed in accordance with the manners as described above. In the case when an ink-repellent material is applied on the surface of a nozzle plate main body 1 in accordance with only spin coat method, there is such a tendency that the ink-repellent material gets into the interiors of the nozzles 11*a* to 11*q* as shown in FIG. 5 so that the ink-repellent material got into the interiors of the nozzles 11*a* to 11*q* must be removed.

On the other hand, an ink-repellent material is spin-coated while jetting an inert gas from the nozzles 11*a* to 11*q* in accordance with a method of applying the ink-repellent film 12 of the present embodiment. Accordingly, invasion of the ink-repellent material into the interiors of the nozzles 11*a* to 11*q* can be prevented.

Besides, since each peripheral border of the openings of the nozzles 11*a* to 11*q* is provided with a curved contour portion in section which continues from each end of the openings of the nozzles 11*a* to 11*q*, spreading of wet regions of the material of the ink-repellent film 12 can be prevented. Thus, the resulting printing quality is improved.

As a result of the examination of ink-jetting performance by means of an unevenness test of ink-landing site, it can be confirmed to improve direct advance of the ink. In other words, the printing quality becomes better.

OTHER EMBODIMENTS

The present invention has been described by referring to the embodiment as described above, it is, however, to be noted that the present invention is not restricted by a part of the description and the figures constituting the disclosure of the invention.

It will be appreciated by those ordinarily skilled in the art that the present invention can be embodied in other specific forms without departing from the spirit or essential characteristics thereof.

For instance, although the ink-repellent material has been applied onto the surface of the nozzle plate main body 1 in accordance with spin coat method in the embodiment, it is also possible to manufacture the nozzle plate main body 1 in accordance with a roller coating method, or a curtain coating method.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A nozzle plate, comprising:

a nozzle plate main body including a plurality of nozzles penetrating through the nozzle plate main body; and an ink-repellent film formed on a surface of the nozzle plate main body and including protruding rings surrounding each of respective nozzle openings defined at the surface of the nozzle plate main body by each of the nozzles, wherein the ink-repellent film is formed over the surface of the nozzle plate main body but is not formed on an inside surface of the nozzle, and a contour of the ink-repellent film in a peripheral portion at a border of the opening in the nozzle is in a shape of a curved portion in section continuing from an edge of the opening of the nozzle.

2. The nozzle plate according to claim 1, wherein the maximum film thickness of the ink-repellent film at the protruding ring is about 20% thicker or more than a film thickness of the ink-repellent film formed on the surface of the nozzle plate except at the peripheral border of the nozzle opening.

3. The nozzle plate according to claim 1, wherein the ink-repellent film is formed by:

flowing a gas to an interior of a nozzle in a nozzle plate from a rear surface to a front surface of the nozzle plate;

applying an ink-repellent material on the surface of the nozzle plate so as to form a film; and drying the film of the ink-repellent material.

4. The nozzle plate according to claim 3, wherein a flow rate of the gas is about 1.0 m/s to about 2.0 m/s.

5. The nozzle plate according to claim 1, wherein the ink-repellent film is formed by:

applying an ink-repellent material onto the surface of the nozzle plate while flowing a gas to an interior of the nozzle plate from a rear surface to a front surface of the nozzle plate so as to form a film; and drying the film.

* * * * *